United States Patent [19]

Fitch

[11] Patent Number: 5,050,874

[45] Date of Patent: Sep. 24, 1991

[54] SWING TRAINING AND EXERCISING APPARATUS

[75] Inventor: Robert E. Fitch, Bloomington, Ind.

[73] Assignee: Gruv-A-Swing, Inc., Norcross, Ga.

[21] Appl. No.: 527,314

[22] Filed: May 23, 1990

[51] Int. Cl.[5] ..... A63B 69/36; A63B 23/00

[52] U.S. Cl. ..... 272/136; 272/67; 273/191 R; 273/191 A; 273/191 B

[58] Field of Search ..... 272/143, 136, 130, 142; 273/191 R, 87 E, 183 E, 191 A, 191 B, 79 B, DIG. 5, 192; 124/41.1, 42, 52

[56] References Cited

U.S. PATENT DOCUMENTS

| | | | |
|---|---|---|---|
| 2,328,408 | 9/1941 | Beil | 273/191 R |
| 2,669,782 | 2/1954 | Turner | 273/183 E |
| 3,415,524 | 11/1968 | Vicker | 272/142 |
| 4,231,568 | 11/1980 | Riley et al. | 272/136 |
| 4,811,944 | 3/1989 | Hoff | 272/143 |

FOREIGN PATENT DOCUMENTS

| | | | |
|---|---|---|---|
| 587140 | 4/1947 | United Kingdom | 273/191 R |

*Primary Examiner*—Richard J. Apley
*Assistant Examiner*—Jerome Donnolly
*Attorney, Agent, or Firm*—N. J. Aquilino

[57] ABSTRACT

A golf swing training and exercising apparatus including a base platform, a vertical support frame angled with respect to the golfer's position and to the intended line of flight, a rotating parabolic shaped arm connected between a simulated golf grip and a resistance source which enables a golfer to execute a simulated golf swing by rotating the arm against the resistance. The structural configuration of the apparatus insures that minimum resistance to the swing execution is provided when the swing is executed with the proper body muscle groups and in the proper swing plane.

13 Claims, 2 Drawing Sheets

SWING TRAINING AND EXERCISING APPARATUS

BACKGROUND OF THE INVENTION

The present invention relates to a golf swing training and muscle exercising apparatus which enables a user to simulate the movements of a proper swing and which also exercises the muscles of the golfer making such a swing, combined in a single apparatus.

In playing the game of golf, optimum shot making performance is achieved when a golf club is swung on a precise plane using specific muscle groups to maximize the energy transfer from the club head to a golf ball. In learning to play the game, many natural tendencies, often learned from playing other sports, must be overcome to properly position the club head relative to a ball during a swing. For example, the properly executed swing requires that the club be swung on an inside to outside path bringing the club head square with respect to the ball at impact using the large muscles of the body in combination with the hands to maximize the power generated during the swing.

Whereas the concepts appear relatively simple, particularly when executed by a highly proficient golfer, in fact it is often difficult, if not impossible, for a beginner to properly train himself in the development and execution of a golf swing. In this regard, many beginning and also experienced players seek the assistance of teaching professionals to learn the fundamentals and also to improve a previously developed golf swing. Using this teacher method, it is usually possible to provide only visual and audible feedback to the player therefore leaving the player to develop the proper swing movements by himself based on this feedback.

Many attempts have been made to provide training and/or exercising devices which enable a golfer to execute a proper golf swing so that a golfer has physical feedback of the swing motion. There have also been a number of exercise devices which are designed to stimulate and strengthen specific muscle groups attuned to the swinging of a golf club.

Among the prior art patents relating to such swing training devices are my own U.S. Pat. No. 3,703,294 for Golf Swing Training Apparatus. Other prior art patents which are designed to exercise golf muscles is shown in U.S. Pat. Nos. 2,848,234 to Brandon for Golf Swing Conditioner, U.S. Pat. No. 3,614,108 to Garten for a Golf Practice Device, and U.S. Pat. No. 4,2229,002 to Masters for a Golf Swing Exercise Device.

There are a number of prior art devices which are specifically designed to teach a player the proper swing movements and swing plane positions of a golf club during a golf swing as shown by the patents to Perrin, U.S. Pat. No. 1,893,920 for Golf Swing Device, U.S. Pat. No. 2,328,408 to Beal et al for Golf Stroke Teaching Machine, U.S. Pat. No. 2,458,932 to Cottingham for Golf Practicing and Teaching Apparatus, U.S. Pat. No. 2,788,214 to Tildon for Golf Teaching and Practicing Device, U.S. Pat. No. 3,319,963 to Cockburn for Golf Swing Guiding Device Including Correct Swing Indicator, U.S. Pat. No. 3,429,571 to Abel for Programmed Swing Training Device, U.S. Pat. No. 3,462,156 to Gentry for Golf Practice Device, U.S. Pat. No. 3,738,661 to Moller for Golf Exercising Device, U.S. Pat. No. 4,262,573 to Richards for Golf Swing Simulator Device, U.S. Pat. No. 4,580,786 to Shippley for Device For Controlling Golf Swing, and U.S. Pat. No. 4,653,757 to Wilkensen for Golf Swing Training Apparatus among a number of others.

Whereas the majority of the prior art works quite well for their intended purposes, they are often complex in nature requiring sophisticated manufacturing and/or installation procedures. Further shortcomings, particularly with the more simple prior art devices, permit the golf club to be swung in a number of different planes while just generally simulating the golf swing arc which actually can train the golfer to make improper swing movements. The prior art exercising devices do not consider the position and plane of the golf club during the exercise device except in a most general way.

When making a golf swing, a line of force which moves the golf club to strike the ball starts with the golfer's pulling motion. This pulling motion follows a parabolic arc which has a starting point above and distal to the golfer's right shoulder. This arc needs leverage to gain momentum and reach increased velocity quickly. The human body is designed in a way which predetermines the best leverage. The golfer's legs, hips, spine, shoulders, arms and hands are the levers.

The body's mechanical levers need to be used to put the golf club in position at the top of the back-swing in as simple or less complicated means as possible. The swing training machine of the present invention has a lever arm that rotates as the golfer swings, thus the resistance for the golfer comes from behind the golfer's swing plane; or from pulling. This resistance to the centrifugal force of the swing must come from a moving arm. When the golfer's leverage is out of alignment with the resistance from the arc arm, the centrifugal force is destroyed and becomes ineffective thus losing leverage and causing restraint.

To strike a golf ball, the force comes from behind the ball and goes forward with the force of the club head at right angles to the target, and a force line directed toward the target will send the golf ball straight to the target.

An improper spinning force right to left will cause the ball to hook. A ball spinning left to right will slice, and a ball with backspin at 21 revolutions will go straight. The ball may go higher or lower in trajectory, but not off line.

Now if the resistance is directly back of the arc for a proper swing, then force applied, but not aligned with the resistance, will cause swing restraint. Swing restraint may be used to prevent either a slice or hook movement.

SUMMARY OF THE INVENTION

The present invention relates to a golf swing training device which also serves as an exercising device to help a golfer develop a correct stance and swing as well as to exercise the muscle groups which are most effective in transferring maximum power to a golf ball struck by a swung golf club. The apparatus includes a base, a telescoping support member positioned in a specific angular orientation with respect to the base, and a parabolically shaped rod, one end of which is connected to a resiliently movable cable and the other end of which is connected to a golf grip. The connector attaching the grip to the end of the rod permits universal movement of the grip with respect to the rod, which, in turn, allows the apparatus to be used by a wide variety of golfers having different individual golf swings. The cable is preferably wrapped around a pulley and connected to a heavy duty spring to provide resistance to the swing motion as the device is being used.

Further features include the adjustability of the length of the cable to increase or decrease the resistance of the spring during the performance of a simulated golf swing. Another feature includes a telescoping support which may be adjustable in a vertical direction to permit use by a variety of golfers of different heights.

Other features of the invention include its ability to be easily assembled and disassembled for transportation and storage. Still another feature is the provision of a golf ball alignment device on the support structure which enables a golfer to determine if he remains in the same position during the execution of the simulated swing.

The structure of the support apparatus and the angular orientation thereof combined with the parabolic rod and the connection between the grip and the rod provide an apparatus which permits an easy, smooth flowing swing to be accomplished when a proper swing plane is simulated, but which creates difficulty in the swing when the golfer is out of position. The resistance of the spring connected to the cable also combines with the aforementioned features to exercise only the proper muscle groups which produce the most desirable swing movements of a golf swing.

It is therefore an object of the present invention to provide a new and improved golf swing training apparatus and combined exercising apparatus. A further object of the present invention is to provide a golf swing training and exercising apparatus which is simple in construction, easy to use, and is adapted to be fitted to a variety of different size and different physical characteristics of golfers. Still another object of the present invention is to provide a golf swing training and exercising apparatus in which the apparatus provides immediate feedback to the golfer of the execution of the golf swing.

Other objects and advantages of the present invention will become apparent from the following drawings and description.

DESCRIPTION OF THE PREFERRED EMBODIMENTS

Figure 2:
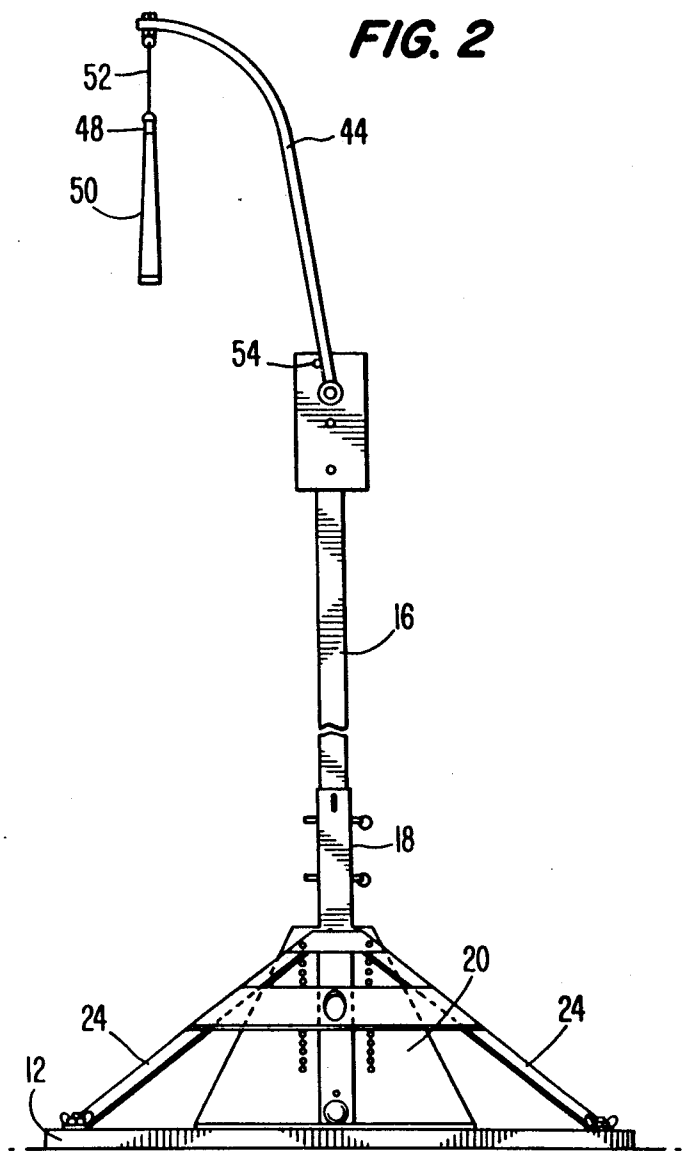
FIG. 2 shows a front elevational view of the apparatus of FIG. 1.

Referring to the drawings, the golf swing training and exercise apparatus 10 of the present invention is formed of a base platform 12 which supports a vertical mounting frame 14 having telescoping upper and lower tubular support elements 16 and 18. The lower tubular support element 18 is secured to the base platform 12 by a support plate 20 which is attached to the base platform 10 using easily removable fastener members 22 such as wing nuts or the like. A pair of support legs 24 provide additional support between the base platform 12 and the lower tubular elements 18 of the vertical mounting frame 14.

The upper tubular support element 16 is telescopically adjustable within the lower tubular element 18. Pins 26 positioned with corresponding pin holes (not shown) in each of the tubular elements 16 and 18 to receive mounting pins 19 to allow for the vertical positioning of the elements 16 and 18 with respect to each other to accommodate golfers of various heights. A thumb screw 28, threadedly attached to the lower tubular element 18, engages the upper tubular element 16 to prevent movement between them.

The upper end of the upper tubular element 16 is connected to a pulley plate 30 which mounts a pulley 32 on one end of a rotatable shaft 34 mounted in an idler bushing 36 secured to the pulley plate 30. A flexible cable 38 is wound on the pulley 30 and passes over a cable guide 40. The free end of the cable 38 is detachably secured to a heavy duty spring 42 which, in turn, is connected to the support plate 20, or any other suitable place on the base platform 12 or lower portion of the mounting frame 14.

A parabolic shaped arm 44 is connected to the other end of the rotatable shaft 34. The parabolic arm 44 is formed with a radius of approximately 16 inches. The free end 46 of the arm 44 is connected to a grip rod 48 preferably formed with a conventional golf grip 50. The grip 50 is attached to the free end 40 of the arm 44 using a linkage arm 52 which permits universal movement between the arm 44 and the grip 50 in order to accommodate the various swing characteristics of the golfers using the apparatus. The pulley plate 30 is provided with an arm stop 54 which maintains the arm 44 in a fixed vertical position by the action of the spring 42 pulling against the cable 38. The cable 38 is provided with a cable adjustment means 45 which permits the length of the cable 38 to be adjusted. It will be appreciated that the shorter the cable 38, the more the spring 42 must be stretched to accommodate the rotation of the arm 44 as described in detail hereinbelow.

Figure 1:
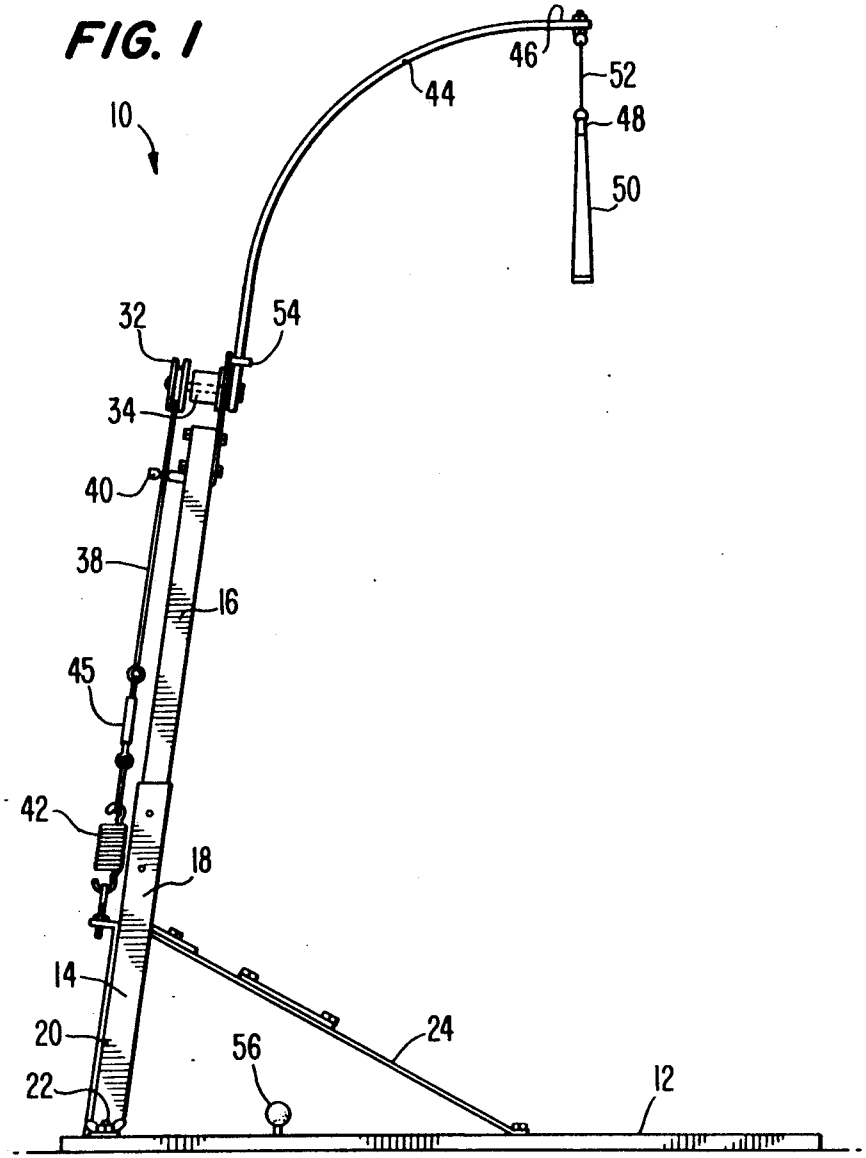
FIG. 1 shows a side elevational view of the golf swing training and exercising apparatus.
Figure 4:
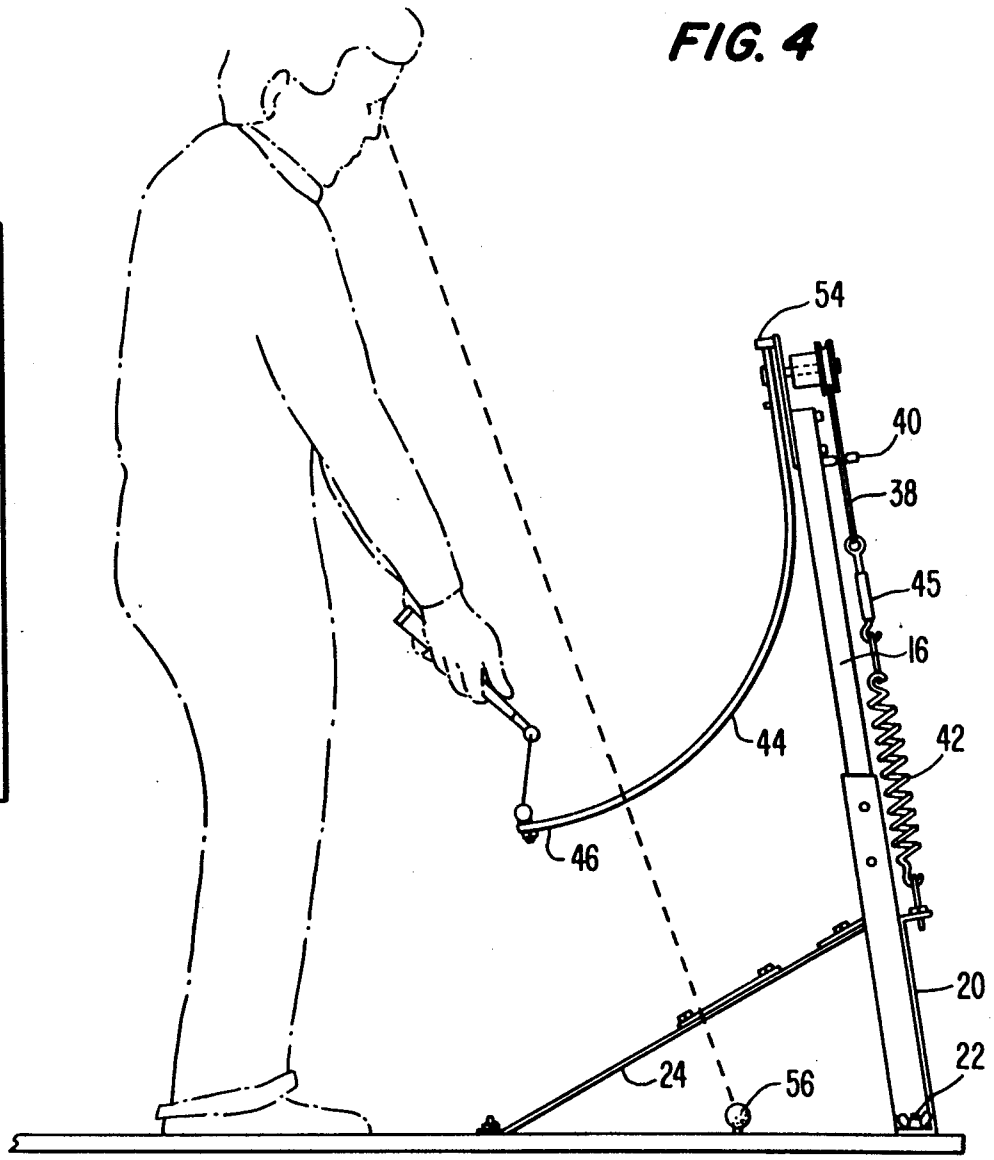
FIG. 4 shows a view with a golfer performing a swing exercise.
Figure 3:
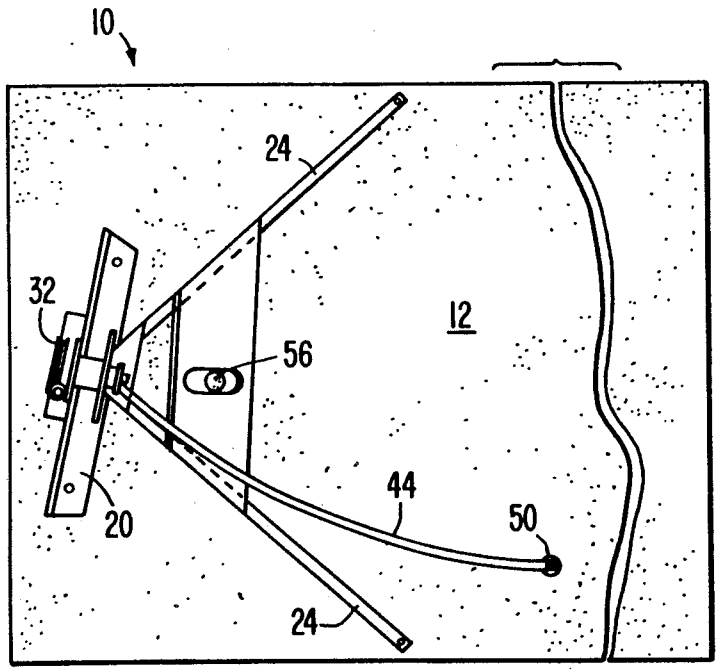
FIG. 3 shows a top plan view of the apparatus of FIG. 1.

Referring to FIG. 1, it can be seen that the vertical mounting frame 14 is disposed at an angle of approximately 8 to 10 degrees with respect to the vertical, and tilted in a direction toward the golfer. Similarly, the support plate 20 is secured to the base platform 12 at an angle of approximately 20 to 22 degrees with respect to the simulate target direction. This orientation of the apparatus permits a golfer to execute a swing in a plane which for most golfers is approximately 68 degrees from ground level and which allows the arm 44 to rotate on a path from the address position above and over the golfer's right shoulder to the proper starting position at the top of the backswing.

In use, a golfer grips the golf grip 50 and rotates the arm 40 in a clockwise direction until the golfer achieves a normal "address position" relative to a ball 56 which is preferably permanently attached to the base platform 12. The arm 44 is held in the address position against the compressive force of the spring 42 on the cable 38 which, in turn, imparts a rotational force on the shaft 34 using the pulley 32. The golfer then makes a normal backswing while holding the grip 50. At the top of the backswing, the golfer reverses direction of movements and commences the downswing against the resistance of the spring 42. Depending upon the strength of the golfer and the adjustment of the length of the cable 38, the swing progresses only a short way past the normal impact position before the spring denies further movement of the grip 50. At this position maximum stress is placed upon the muscle groups, particularly in the legs, back and shoulders, which are used to make the swing. The golfer may then make a number of repetitions of the same swing motion not only to exercise the various muscle groups, but also to provide muscle memory to the brain as the apparatus is respectively swung.

If the golfer's swing motion is not in the proper plane, the lever arm of the swing training device will encounter resistance as described hereinabove and the golfer will obtain immediate feedback that the swing motion is improper. The natural tendency will be for the golfer to adjust his swing motion to minimize the resistance which will result in a proper swing plane.

Another feature of the apparatus 10 provides a visual indication that a golfer's head is moving with respect to the ball 56 during a simulated golf swing by using a sight plate 58 vertically disposed over the ball 56 and mounted on the legs 24. The sight plate 58 is provided with an opening 60 sized to exactly view the ball 56. If the golfer's head moves, the ball 56 either partially or completely disappears from the opening 60.

With this feature a user can train himself to stay in position with respect to the ball to be struck.

It will be appreciated that modifications may be made to the above described invention in keeping within the scope of the appended claims.

I claim:

1. A gold swing training and exercise apparatus for simulating the proper swing path and for exercising the gold swing muscles comprising:

a base for supporting a user;

a mounting frame connected to said base and extending in a generally vertical direction;

a parabolic shaped swing arm having a vertical proximal end rotatably attached to said mounting frame by a shaft which rotates with said swing arm and extending in an arcuate configuration toward a user of said apparatus and having a distal end terminating in a generally horizontal direction;

a handle in the shape of a gold grip;

a linkage member connecting said handle to said distal end of said swing arm for permitting universal movement between said handle and said swing arm; and, a resistance means cooperating with said shaft for providing resistance to movement of said swing arm when said swing arm is rotated by said user during the simulation of a golf swing.

2. The apparatus of claim 1 wherein said base is a platform extending in a horizontal plane and structured to support a user on a flat ground surface.

3. The apparatus of claim 2 wherein said mounting frame is formed of an upper and lower tubular support elements telescopically connected and adjustable each with the other in a vertical direction.

4. The apparatus of claim 3 further including a support plate and legs for supporting said mounting frame on said platform.

5. The apparatus of claim 1 wherein said swing arm is a rigid, metallic rod.

6. The apparatus of claim 1 wherein said resistance means includes a pulley attached to said shaft and a cable, one end of which is wound on said pulley and the other end of which is attached to a resistance.

7. The apparatus of claim 6 wherein said resistance is a spring.

8. The apparatus of claim 1 wherein said resistance means is a spring.

9. The apparatus of claim 2 further including an alignment means to aid said user in maintaining a proper body position while using said apparatus, said alignment means including a target on said base platform and a window vertically raised from said target and sized to view said target when said user is in a proper position and to obscure at least a portion of said target when said user is out of position.

10. The apparatus of claim 9 wherein said target is a golf ball.

11. The apparatus of claim 1 wherein said mounting frame deviates from the vertical position by an angle of approximately 8 to 12 degrees toward the user and said mounting frame deviates from the intended line of flight by approximately 18 to 20 degrees.

12. The apparatus of claim 3 wherein each of said tubular support elements includes a plurality of openings in registery with the corresponding holes on the opposite support element; said holes being structured to receive mounting pins for supporting said tubular elements in a preselected position relative to each other for vertical adjustment thereof.

13. A gold swing training and exercise apparatus for simulating the proper swing path and for exercising the gold swing muscles comprising:

a base for supporting a user;

a mounting frame connected to said base and extending in a generally vertical direction;

a parabolic shaped swing arm having a vertical proximal end rotatably attached to said mounting frame by a shaft which rotates with said swing arm and extending in an arcuate configuration toward a user of said apparatus and having a distal end terminating in a generally horizontal direction;

a handle in the shape of a gold grip;

a linkage member connecting said handle to said distal end of said swing arm said linkage member permitting universal movement between said handle and said swing arm; and, a resistance means connected to said swing shaft for providing resistance to movement of said swing arm when said swing arm is rotated by said user during the simulation of a golf swing.

* * * * *

UNITED STATES PATENT AND TRADEMARK OFFICE

CERTIFICATE OF CORRECTION

PATENT NO. : 5,050,874

DATED : September 24, 1991

INVENTOR(S) : Robert E. Fitch

It is certified that error appears in the above-identified patent and that said Letters Patent is hereby corrected as shown below:

Column 5, Claim 1, line 28, change the word "gold" to --golf--.

Column 5, Claim 1, line 30, change the word "gold" to --golf--.

Column 5, Claim 1, line 40, change the word "gold" to --golf--.

Column 6, Claim 13, line 36, change the word "gold" to --golf--.

Column 6, Claim 13, line 38, change the word "gold" to --golf--.

Column 6, Claim 13, line 48, change the word "gold" to --golf--.

Signed and Sealed this

First Day of June, 1993

*Attest:*

Michael K. Kirk

MICHAEL K. KIRK

*Attesting Officer*

*Acting Commissioner of Patents and Trademarks*